US005987750A

United States Patent [19]

Tally

[11] Patent Number: 5,987,750

[45] Date of Patent: Nov. 23, 1999

[54] TUBE CUTTING TOOL

[75] Inventor: Kevin Tally, Rural Clarinda, Iowa

[73] Assignee: The Lisle Corporation, Clarinda, Iowa

[21] Appl. No.: 09/058,480

[22] Filed: Apr. 10, 1998

[51] Int. Cl.[6] ..... B26B 13/00

[52] U.S. Cl. ..... 30/92; 30/94; 30/108; 30/134; 30/252; 30/254; 30/260; 30/341; 81/416

[58] Field of Search ..... 30/92, 94, 108, 30/131, 134, 249, 250, 252, 254, 260, 340, 341, 363; 81/416, 417

[56] References Cited

U.S. PATENT DOCUMENTS

| | | | |
|---|---|---|---|
| 4,336,652 | 6/1982 | Robertson | 30/92 |
| 4,412,380 | 11/1983 | Kish | 30/92 |
| 4,785,538 | 11/1988 | Meyer | 30/92 |
| 4,872,455 | 10/1989 | Pinchuk et al. | 30/92 |
| 5,012,579 | 5/1991 | Matsumoto | 30/92 |
| 5,197,879 | 3/1993 | Fowler, III et al. | 81/416 |

FOREIGN PATENT DOCUMENTS 1178426 11/1984 Canada .

OTHER PUBLICATIONS

MAC Tools, 1990 catalog, DG1000 Multi–Cutter, p. 269.
Matco Tools, '96/'97 catalog, HC14 Hose and Cable Cutter, p. 173.
Snap–On Tools, 1995 catalog, A174CP Hose Clamp Cutter, p. E63.
Snap–On Tools, 1995 catalog, YA1000 Multi–Cutter, p. E63.
Snap–On Tools, 1995 catalog, PWC60 Compound Leverage Hose Cutter, p. E63.

*Primary Examiner*—M. Rachuba
*Attorney, Agent, or Firm*—Banner & Witcoff, Ltd.

[57] ABSTRACT

A hose cutter tool includes scissor arms joined at a pivot point having opposed jaws, one of which includes a cutter blade and the other of which defines an arcuate support surface to hold tubing material. As the arms are manipulated, the blade descends through and cuts the tubing material.

8 Claims, 4 Drawing Sheets

TUBE CUTTING TOOL

BACKGROUND OF THE INVENTION

This invention relates to a device for cutting tubing and the like, and more particularly, to a device which includes arm members that are connected to operate with a scissors action and include jaws that facilitate positioning of a tube appropriately for proper engagement by a jaw mounted blade that cuts the tube.

Canadian Patent No. 1,178,426 discloses a scissors type tube cutter which includes a pair of opposed jaws. One jaw has a v-shaped tube support surface which positions a tube for engagement by a blade held by the other jaw. Importantly, the blade is offset from the center line of the v-shaped tube holding jaw to insure a slicing stroke by the blade against a tube positioned by the v-shaped support surface. The device disclosed has been commercialized and is useful. However, there has remained the need to provide an improved tube or hose cutter, especially for use in the automotive repair field. The present invention is directed to such an improved tube or hose cutter.

SUMMARY OF THE INVENTION

Briefly, the present invention comprises a hose cutter tool which includes first and second arm members joined at a central pivot connection. The arm members each include a handle at one end and a jaw at the opposite end. Manual manipulation of the handles causes the jaws to move from an open position toward one another to a closed position. One of the jaws includes a cutting blade which has a point defined by cutting edges that converge to form the point. The blade lies in the plane defined by the scissors action of the jaws. The other of the jaws includes a smoothly curved hose support surface, generally transverse to the plane defined by the cutting blade. The curved surface defines a bisector line and the point of the blade intersects that bisector line upon closure of the jaws. Jaw closure drives the blade against tubing supported on one jaw and cuts a material supported in the curved support surface.

Thus it is an object of the invention to provide an improved tube or hose cutter.

It is a further object of the invention to provide an improved hose cutter which has a scissors-type action and includes a removable cutting blade.

Yet a further object of the invention is to provide a hose cutter wherein the hose or tubing to be cut is supported on a curved surface having a midpoint line, or bisector line, the curved surface shaped so as to substantially center the hose or tube on the bisector line as it is cut.

Yet a further object of the invention is to provide a hose or tube cutter wherein the cutting blade is removable or replaceable and is symmetrical as well as reversible.

These and other objects, advantages and features of the invention will be set forth in the detailed description which follows.

BRIEF DESCRIPTION OF THE DRAWING

In the detailed description which follows, reference will be made to the drawing, comprised of the following figures.

DESCRIPTION OF THE PREFERRED EMBODIMENT

Figure 1:
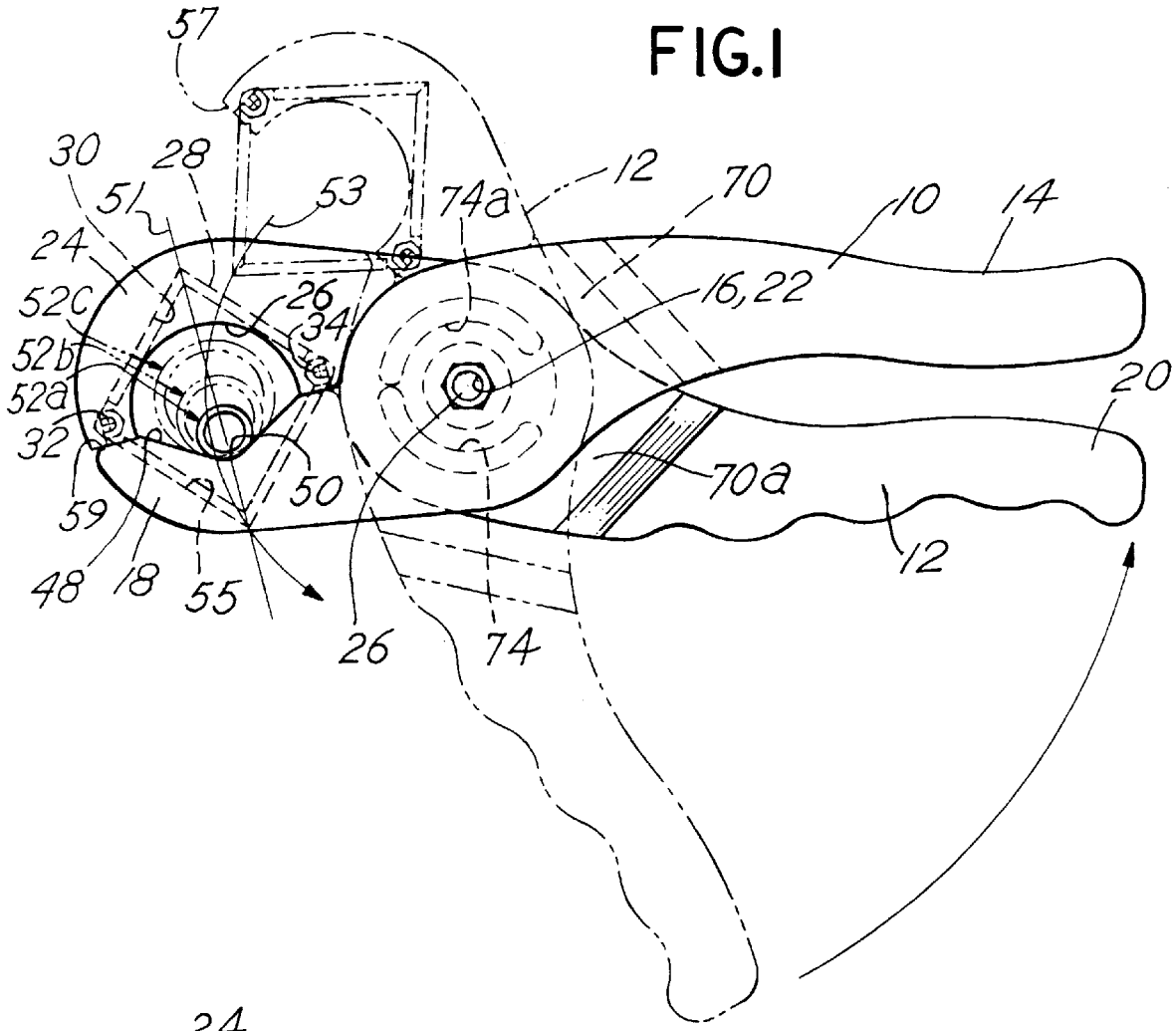
FIG. 1 is a side elevation of the improved hose or tube cutter of the invention.
Figure 2:
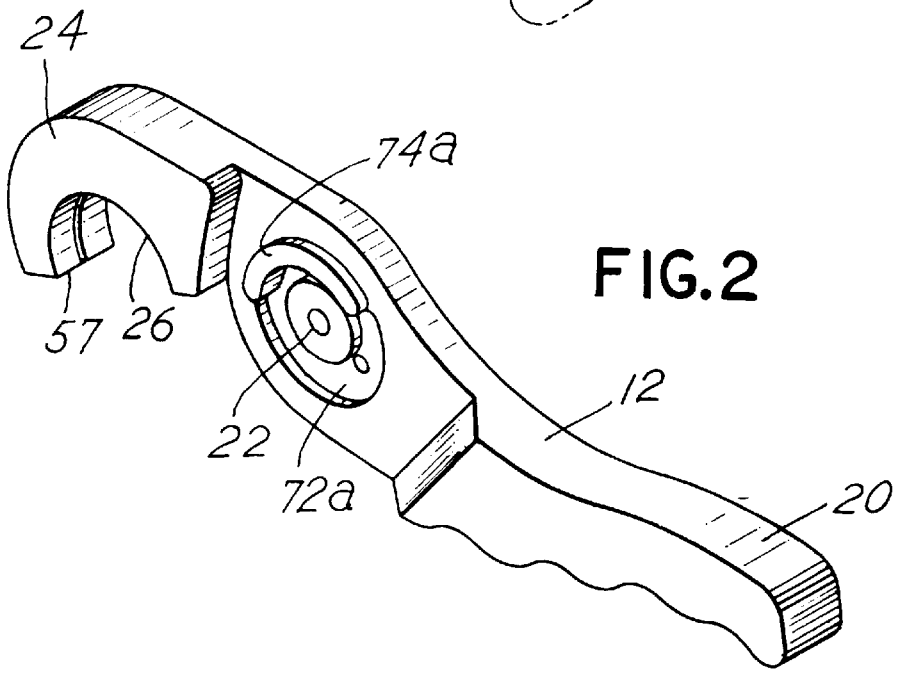
FIG. 2 is a perspective view of one arm of the cutter of FIG. 1.
Figure 3:
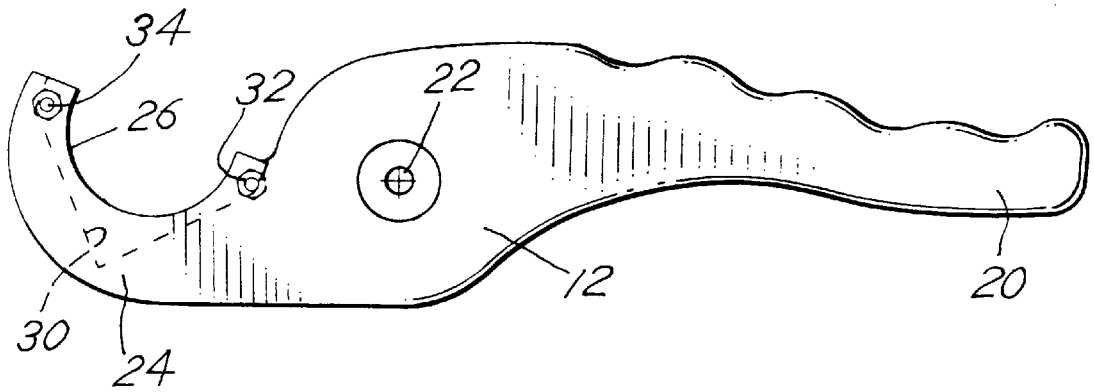
FIG. 3 is an outside elevation of the arm of FIG. 2.
Figure 4:
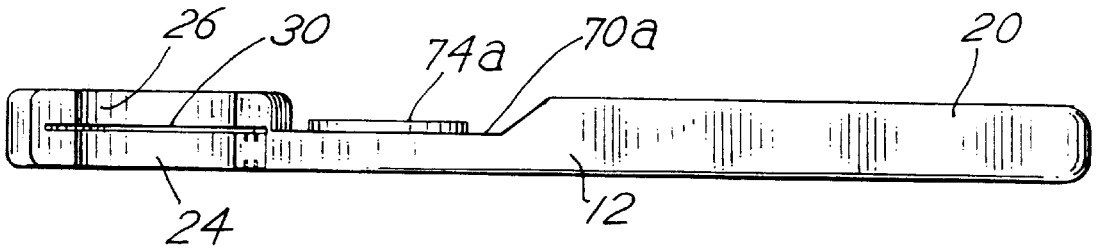
FIG. 4 is a top plan view of the arm of FIG. 2.
Figure 5:
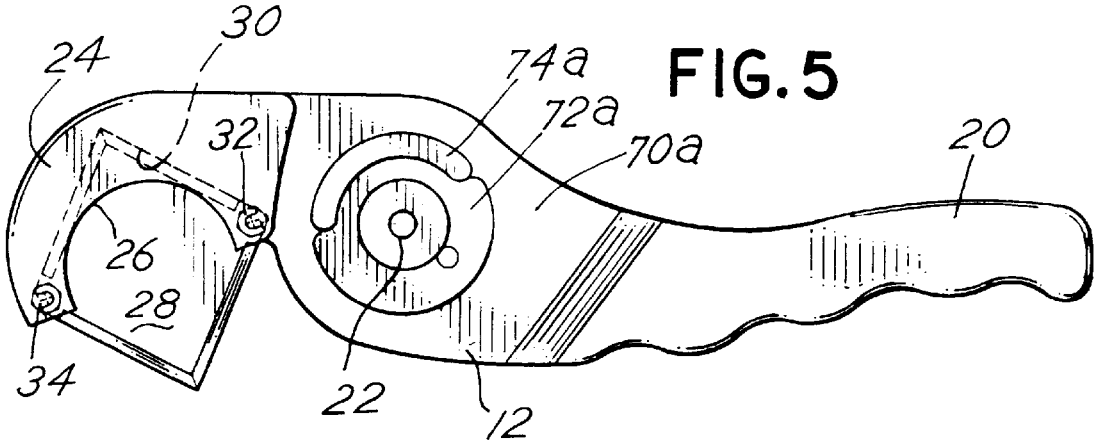
FIG. 5 is an inside elevation of the arm of FIG. 2.
Figure 6:
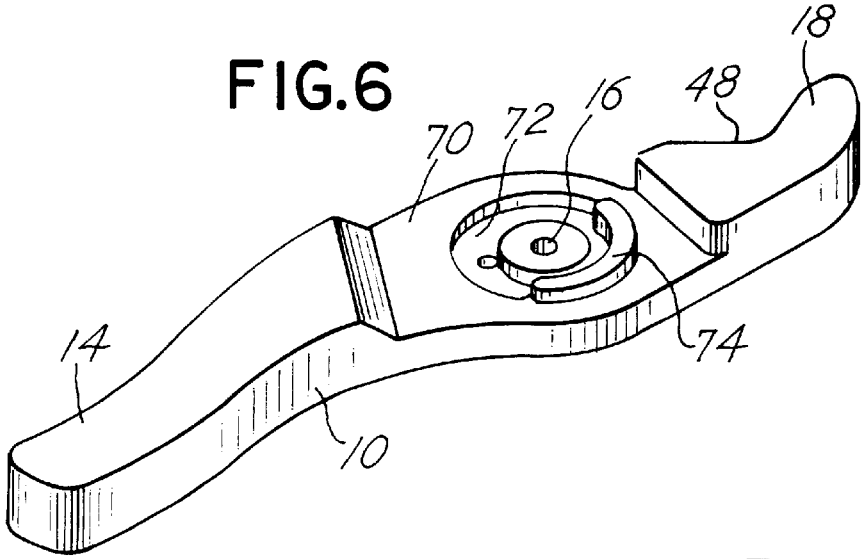
FIG. 6 is a perspective view similar to FIG. 2 depicting the other arm of the cutter.
Figure 7:
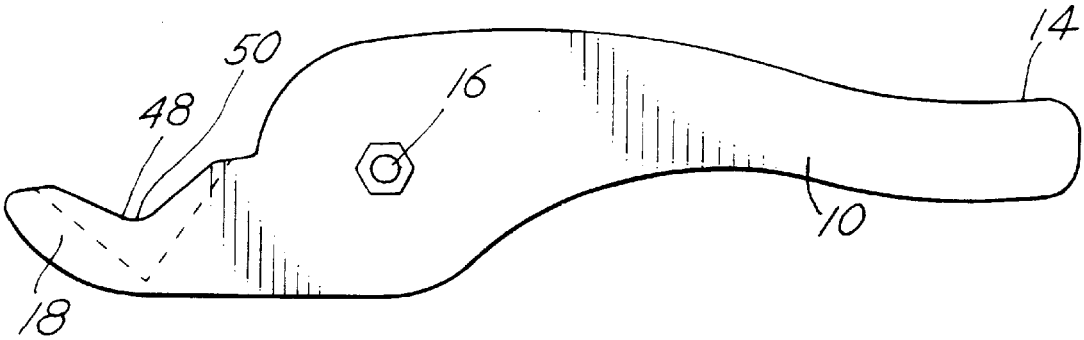
FIG. 7 is an outside elevation of the arm of FIG. 6.
Figure 8:
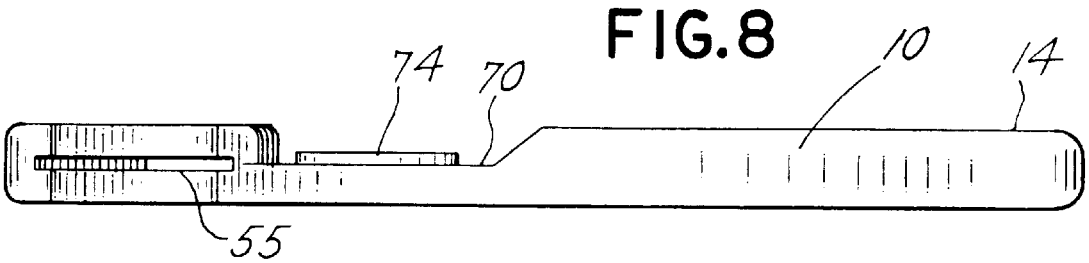
FIG. 8 is a top plan view of the arm of FIG. 6.
Figure 9:
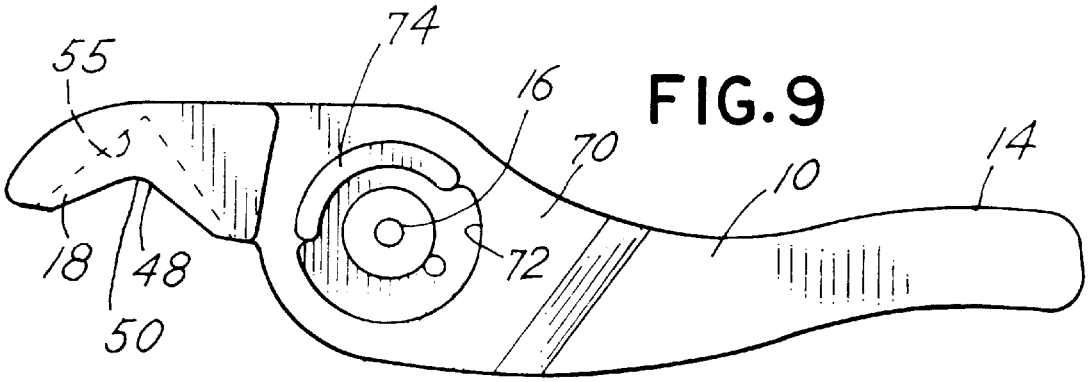
FIG. 9 is an inside elevation of the arm of FIG. 6.
Figure 10:
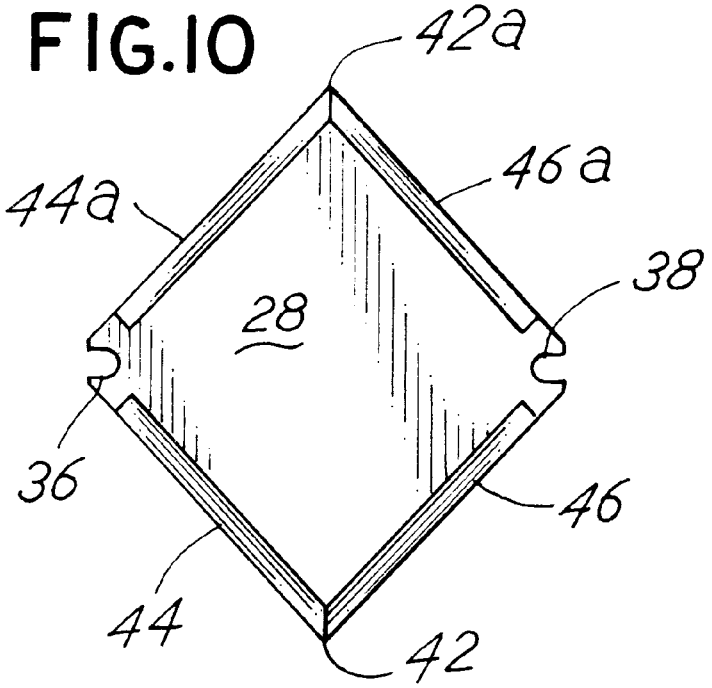
FIG. 10 is a plan view of a typical blade utilized in the practice of the invention.
Figure 11:
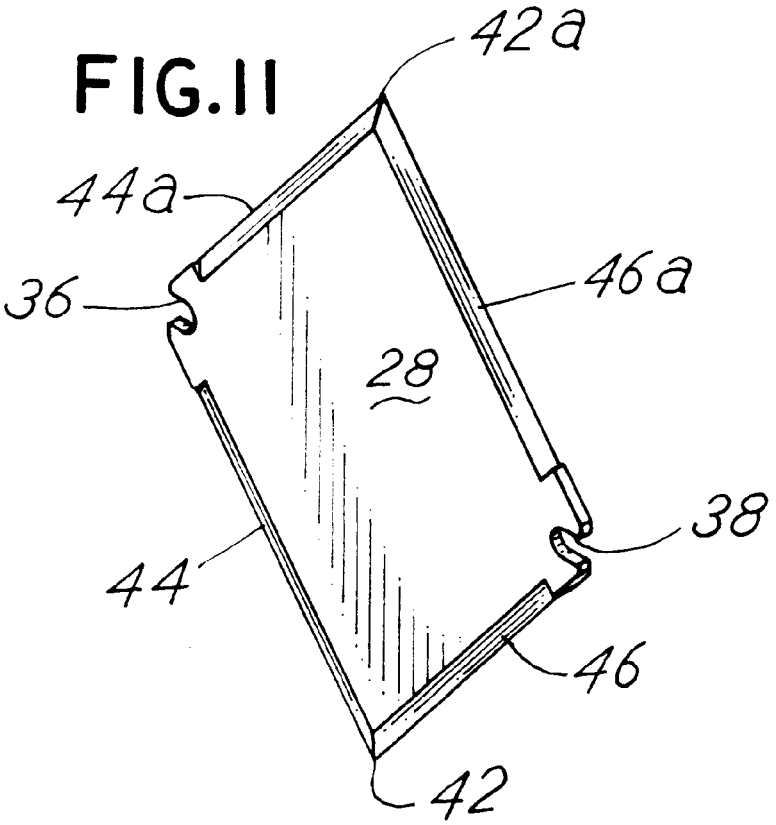
FIG. 11 is a perspective view of the blade construction.

Referring to the figures, the tube or hose cutter of the invention includes a first arm member 10 and a second arm member 12. The first arm member 10 includes a handle 14 at one end, an intermediate pivot opening 16, and a jaw 18 at the opposite end. The second arm 12 likewise includes a handle 20 at one end, an intermediate pivot opening 22, and a lower jaw 24 at the opposite end. The arms 10 and 12 are joined together for pivotal, or scissors-type action, by a pin 26 extending through the pivot openings 16, 22. The handles 14 and 20 may or may not include grips, such as molded rubber grips. The handles 14 and 20 operate in a scissors-type manner. Thus, as the handles 14, 20 approach one another due to manual manipulation, the jaws 18 and 24 also will approach one another.

The upper or top jaw 24 includes an arcuate or curved surface 26. A blade 28 is mounted in a slot 30 in the upper jaw 24. The blade 28 may be diamond shaped or rectangular and is retained by retainer pins or screws such as pins 32 and 34 in the upper jaw 24. The blade 28 thus includes small detents 36 and 38 which cooperate with the pins 32 and 34 respectively. The blade 28 may be reversible.

The blade 28 includes a point 42 and cutting edges 44 and 46 which diverge in opposite directions from the point 42. The edges 44, 46 are sharpened and the point 42 is also sharpened. The edges 44 and 46 may be symmetric as depicted, or asymmetric. The symmetric configuration is preferred.

In the preferred embodiment, the blade 28 is symmetric in all respects. That is, the blade 28 is generally square or diamond shaped and thus the sides of the blade may define 90° angles, one with respect to the other, as depicted in the figures. The edges or sides 44, 46 are thus at a right angle or an acute angle, one with respect to the other, and the edges 44 and 46 are sharped and converge to the point 42. On the opposite side of the blade 28, a point 42*a* is defined by converging edges or sides 44*a* and 46*a*. Again, the sides 44*a* and 46*a* converge at a 90° angle or other acute angle. The juncture of the edges 44 and 44*a* include a passageway or slot 36, and the convergence of the edges or sides 46 and 46*a* also define a slot detent or opening 38. Note that with the design described, the blade 28 may be reversed so that the point 42*a*, rather than the point 42, is engagable with a tube retained by the hose cutter. Further, the slots or detents 36 and 38 may be reversed to cooperate with fasteners 32 and 34, or 34 and 32.

The lower jaw 18 includes a curved tube or hose support surface 48 which is generally transverse to the plane defined by the blade 28 as the blade 28 moves toward the surface 48. The surface 48 has a midpoint 50 and a slot 55 for receipt of blade 28 as the jaws 18, 24 close. The surface 48 may, for example, comprise a portion of a cylindrical surface, a portion of an elliptical surface, or a portion of some other curved surface. In each event, the curved surface 48 will include a midpoint 50. The midpoint 50 lies on a bisector 51. The surface 48 is preferably configured to position the center of a tube 52 on the bisector 51.

In the figure depicting the jaws 18, 24 and arms 10, 12 of the tube cutter, an outline of the outer diameter of tubes 52*a*, 52*b*, 52*c* lying on the surface 48 are depicted. Note that the tubes 52*a*, 52*b*, 52*c* include centers which lie on the bisector 51. This alignment is achieved by choice of the shape of the curved surface 48 to appropriately align tubes 52 thereon. As the upper jaw 24 is closed, the upper jaw 24 will transfer the blade 28, and more particularly, the point 42 of the blade 28 along a path which is arcuate and is defined by the arc 53. The arc 53 passes through the bisector 51 as the jaw 24 is closed and moves toward the lower jaw 18. The point 42 of the blade 28 thus pierces a tube 52 and the sharpened edges 44, 46 shear the tube 52 retained on the surface 48. The point 42 then passes through a pathway which, when the jaws 18 and 24 are fully closed, positions the point 42 on the bisector 51, again as depicted in the figures. The point 42, thus, is designed to pass through tubing and may, in fact, pass on both sides of the bisector 51 as the blade 28 passes through or shears tubing 52. The slot 55, into which the blade 28 is positioned as the jaws 18 and 24 close, is sufficiently deep so that the blade 28 does not engage with or contact the sides of the slot 55 in the preferred embodiment. Rather, the upper jaw 24 includes a contact surface 57 which engages with a counterpart contact surface 59 of the lower jaw 18 to limit the scissors or pivotal movement of the jaws 18 and 24. The forces on the blade 28 thus do not impinge on any of the cutting edges 44, 44*a*, 46 and 46*a* inasmuch as the pins or lugs 32 and 34 serve as the means for retaining the blade in the upper jaw 24 and for transferring adequate cutting force from the upper jaw 24 to the blade 28. Thus, the lower jaw 18 also includes slot 55 for receipt of the blade 28. Again, the slot 55 does not limit the motion or position of the blade 28 and thus does not cause the edges 44*a* and 46*a* to become dulled. Rather, the slot 55 defines a means for aligning and appropriately positioning the blade 28 and further provides a safety feature inasmuch as if one of the pins 32 or 34 should fracture or break, the slot 55 will tend to hold the blade 28 in position.

The tool is designed so that as the blade 28 moves to the closed position, it intersects the bisector 51 of the curved surface 48. In this manner, a hose or tube 52 which is retained between the blade 28 and the curved surface 48 will receive a positive cutting action of the blade 28. The preferred construction of the blade 28 is to have straight edges 44, 46 although curved edges 44, 46 may be utilized.

The curved surface 48 will typically have a uniform radius of curvature though again as expressed above other curved shapes may be utilized. The blade 28 may be permanently affixed or removable from the jaw 24. Note that the upper jaw 24 includes the curved surface 26 so that as the blade 28 impinges and cuts through a hose such as hose 52, the jaw 24 will not interfere with the hose 52 and will not compress the hose 52. That is the blade 28 will effect the shearing action through the hose.

The arms 10 and 12 have a pivot connection assembly cast or molded therein which facilitates the interrelationship of the separate arms 10 and 12, limits the pivotal motion thereof, and enhances the cooperative engagement of the arms 10 and 12. Thus, referring to the figures, and in particular, the figures associated with the arm 10, the arm 10 includes a recess 70 which is compatible with a similar recess 70*a* associated with the arm 12. The recess 70 includes a partial cylindrical counterbore 72 and a partial cylindrical projecting rib 74 which has the same radial extent as the cavity 72. The arm 12 includes a similar radial rib 74*a* which is positioned on or within to fit within the arcuate recess 72. The arcuate rib 74 thus fits into a compatible cavity 72*a* of arm 12.

The ribs 74 and 74*a* have an arcuate length less than 180° to provide, in combination, a means for limiting and controlling the extent that the arms 10 and 12, and more particularly, the jaws 18 and 24 can be opened. The arcuate ribs 74, 74*a* also interact in the associated cavities 72 and 72*a* to permit the jaws 18 and 24 to be fully closed, as depicted in the figures, whereby the ends 57, 59 of the jaws 18, 24 will engage to limit the pivotal movement of the arms 10 and 12 with respect to one another.

In practice, the arms 10 and 12 may be manufactured from a glass filled nylon material. By way of example, a 30% glass filled nylon material so that they may be molded in a manner which will provide for appropriate strength to effect a cutting operation, yet will be sufficiently economical and capable of easy assembly. The arcuate extent of the cavities 72 and 72*a* is greater than 180° so as to define the limit of travel of the respective rib 74 or 74*a* located therein.

Other variations to the construction are possible. The shape of the blade and the particular curvature of the lower jaw 18 may be altered, for example, the dimension, radial position and circumferential extent of ribs 72, 72*a* and recesses 74, 74*a* may be varied. Thus the invention is to be limited only by the following claims and equivalents thereof.

What is claimed is:

1. A hose cutter tool comprising, in combination:

first and second arm members, each member including a handle, a working jaw and a pivot intermediate the handle and jaw for connecting the arm members to permit scissors action of the jaws in response to manipulation of the handles;

one of said jaws including a removable cutting blade, said blade comprising a four sided flat plate with four sharpened edges and an attachment detent defined at the juncture of two pair of intersecting edges and two cutting points defined at the other juncture of the edges converging to each point, said blade lying in a plane defined by the scissors action of the jaws; and the other of said jaws including a smoothly curved support surface with a bisector line, said support surface generally transverse to the plane defined by the blade, said curved surface having a slot for receipt of the blade, said slot having a midpoint positioned on the bisector lines said blade point intersecting the midpoint upon closure of the jaws to cut material supported by the curved support surface, said blade retained in one of the jaws by attachment members through the blade detents, said blade being reversibly mounted in the jaw to align either point with the bisector line.

2. The tool of claim 1 wherein the curved surface has a uniform radius of curvature.

3. The tool of claim 1 wherein the blade edges are straight.

4. The tool of claim 1 wherein the blade is symmetric about the point.

5. The tool of claim 1 wherein an arm member includes a radial rib partially around the pivot and the other arm includes a radial slot to receive the radial rib, said slot extending partially around the pivot.

6. The tool of claim 5 including a radial rib and slot defined in each arm, each rib of one arm positioned in a slot of the other arm.

7. A hose cutter tool comprising, in combination:

a first arm member and a second arm member, said arm members pivotally connected together to form a pliers construction, said first arm member including a first jaw, said second arm member including a second jaw, said first and second jaws opposed to each other and each jaw including a curved support surface for a hose, said curved surfaces being in opposed relation to one another, the second curved jaw support surface defining a bisector of the curve defined by said second curved jaw support surface, each jaw further including an aligned opposed slot transverse to the curved support surfaces, the first jaw further including spaced, removable, blade support pins;

a four sided, flat cutting blade having four corners, and four sharpened edges, two opposed corners having a detent opening aligned for receipt of the blade support pins when the blade is in the slot of said first jaw, the remaining two corners defining a tube piercing point, each of said points being capable of being aligned to intersect the bisector of the curved support surface of the second jaw when mounted in the first jaw and the jaws are closed, said blade being reversibly mounted in the slot of the first jaw by said pins.

8. The tool of claim 7 wherein each arm includes a pivot connection assembly comprising an arcuate rib projecting from an internal face of said handle in opposition to an arcuate counterbore in the internal face of the opposed handle, said ribs slidably engaged with the opposed counterbore, and further including a center pivot connecting the arms, said rib and counterbore spaced radially from the pivot of the arms.

* * * * *